US008061818B2

(12) United States Patent
Murakami

(10) Patent No.: US 8,061,818 B2
(45) Date of Patent: Nov. 22, 2011

(54) INK JET RECORDING HEAD

(75) Inventor: Shuichi Murakami, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 394 days.

(21) Appl. No.: 12/275,987

(22) Filed: Nov. 21, 2008

(65) Prior Publication Data

US 2009/0141091 A1 Jun. 4, 2009

(30) Foreign Application Priority Data

Nov. 30, 2007 (JP) ..... 2007-310942

(51) Int. Cl.
*B41J 2/05* (2006.01)
*B41J 2/04* (2006.01)

(52) U.S. Cl. ..... 347/65; 347/54

(58) Field of Classification Search ..... 347/54, 347/56, 61, 62, 64, 65, 66, 67
See application file for complete search history.

(56) References Cited

U.S. PATENT DOCUMENTS 5,734,399 A * 3/1998 Weber et al. ..... 347/65
5,946,012 A * 8/1999 Courian et al. ..... 347/63
6,137,510 A 10/2000 Sato et al.
6,190,005 B1 2/2001 Murakami
6,286,933 B1 9/2001 Murakami et al.
6,443,561 B1 9/2002 Murakami
6,520,626 B1 2/2003 Murakami
6,540,335 B2 4/2003 Touge et al.
6,755,510 B2 6/2004 Murakami et al.
6,789,877 B2 9/2004 Murakami et al.
6,830,309 B2 12/2004 Murakami
6,830,317 B2 12/2004 Tsuchii et al.
6,848,769 B2 2/2005 Murakami
6,854,820 B2 2/2005 Murakami et al.
6,896,357 B2 5/2005 Murakami et al.
6,935,723 B2 8/2005 Murakami et al.
6,971,736 B2 12/2005 Tomizawa et al.
7,452,056 B2 11/2008 Mizutani et al.
2004/0218007 A1 11/2004 Tomizawa et al.
2007/0146437 A1 6/2007 Murakami et al.

* cited by examiner

*Primary Examiner* — Geoffrey Mruk
(74) *Attorney, Agent, or Firm* — Fitzpatrick, Cella, Harper & Scinto

(57) ABSTRACT

An ink jet recording head includes ejection energy generating elements for ejecting ink, flow passages for supplying the ink from an ink supply port to the ejection energy generating elements through a common liquid chamber, a partition wall formed between adjacent two flow passages, a member disposed between the partition wall and the ink supply port, and an opening formed between the partition wall and the member. A flow resistance in the opening from one of the adjacent two flow passages to the other flow passage is different from that in the opening from the other flow passage to the one of the adjacent two flow passages.

6 Claims, 6 Drawing Sheets

INK JET RECORDING HEAD

FIELD OF THE INVENTION AND RELATED ART

The present invention relates to a recording apparatus and a liquid ejection recording head, particularly an ink jet recording head.

As one of ink jet recording apparatuses, a bubble jet (registered trademark) recording apparatus has been known. In this recording apparatus, energy such as heat or the like is imparted to ink, so that the ink is caused to bring about a change in state with abrupt volume change (bubble generation) and is ejected from an ejection outlet by an acting force on the basis of this change in state, thereby to be deposited on a recording medium (material) to carry out image formation.

An ink jet recording head used in such an ink jet recording apparatus will be briefly described. The recording head generally includes an ejection portion provided with ejection outlets for ejecting the ink, liquid flow passages for introducing the ink into these ejection outlets, and ejection heaters. The ejection heater is an electrothermal transducer element, for generating thermal energy utilized for ink ejection, disposed in the liquid flow passage. In the recording head, the liquid flow passages are disposed in a plurality of arrays of liquid flow passages to constitute an ejection outlet surface of the ejection outlets. When an ejection outlet surface-side of the respective liquid flow passages is taken as a front portion, a rear portion opposite from the front portion is connected to a common liquid chamber for supplying the ink to the front portion of the respective liquid flow passages.

In such a constitution, when an ink droplet is ejected from the ejection outlet by heating the ink by utilizing the thermal energy from the ejection heater to cause bubble generation, the ink is re-supplied from the common liquid chamber to the front portion of the liquid flow passage (refilling).

An ink jet recording apparatus in which such a recording head is mounted is capable of recording a high-quality image at high speed and with low noise. Further, the ejection outlets can be disposed at high density, so that the recording apparatus has many advantages such as easy recording of not only a recording image and a monochromatic image but also a color image with a high resolution and a small size considering a size of a recording medium.

For this reason, in recent years, the ink jet recording apparatus is utilized in much office equipment such as a printer, a copying machine, a facsimile machine, and the like as an output portion of a personal computer which has been popularized.

However, in the recording head employed in such an ink jet recording apparatus, nozzles including ejection outlets, ejection heaters, and liquid flow passages are disposed at a high density, so that a distance between adjacent nozzles is further shortened. For that reason, there was an influence of an undesirable fluidal interaction between the adjacent nozzles (hereinafter referred to as a "cross-talk").

Specifically, in a nozzle, ink is heated to cause bubble generation by utilizing thermal energy from an ejection heater for ink ejection, the bubble generation grows not only in an ejection direction but also in a direction toward a common liquid chamber, thus causing flow of the ink in the direction toward the common liquid chamber. The ink flowing toward the common liquid chamber also flows into a nozzle, adjacent or close to the nozzle causing the bubble generation, from a rear portion of a liquid flow passage to unstabilize the ejection. In order to solve this problem, U.S. Pat. No. 6,830,317 has reduced a degree of the cross-talk by providing a partition wall between the adjacent nozzles.

However, when the degree of the cross-talk is intended to be reduced by the above-described means, such a problem that it takes time to re-supply the ink has arisen. When the re-supply of the ink requires time, a drivable frequency cannot be set at a higher level, with the result that a printing speed is lowered.

On the other hand, as a method of arranging the nozzles, there is a method of arranging ejection outlets in a staggered fashion in order to obtain a high resolution. FIG. 5 is a front view showing an embodiment of an ejection portion in the case where ejection outlets of a nozzle are arranged in a staggered fashion. In the figure, a vertical direction is taken as a Y axis direction and a left-right direction is taken as an X axis direction.

As shown in FIG. 5, a liquid flow passage 7 of each nozzle is defined by a flow passage constituting portion 4 surrounding side surfaces of the liquid flow passage 7. An unshown ejection outlet plate covers the flow passage constituting portion 4 and the liquid flow passage 7. On the ejection outlet plate, ejection outlets are provided at positions correspondingly to electrothermal transducer elements 1 constituting the ejection heaters. Ink is supplied from an ink supplying chamber (not shown) to a common liquid chamber 360 through an ink supply port 3.

In FIG. 5, nozzles 310 having a shorter distance from the common liquid chamber 360 to the ejection outlet and nozzles 300 having a longer distance from the common liquid chamber 360 to the ejection outlet are disposed alternately with respect to the Y axis direction. When the ejection outlets of the nozzles 300 and the ejection outlets of the nozzles 310 are separately viewed, the respective ejection outlets are disposed on the same Y axis coordinates but are on different lines. An X coordinate of the electrothermal transducer elements for the nozzles 300 is different from an X coordinate of the electrothermal transducer elements for the nozzles 310.

Even in the nozzle arranging method shown in FIG. 5, the nozzles 300 have a distance from the common liquid chamber 360 to the ejection outlet that is longer than that of the nozzles 310, so that the ink re-supply requires longer time. For that reason, the nozzle arranging method is required to shorten a time of re-supply of the ink to the ejection outlets of the nozzles 300, by effecting a layout change such that a partition wall 350 is decreased in length with respect to the X axis direction, while reducing the degree of the cross-talk.

As a method of reducing the degree of the cross-talk, in addition to the above-described method, there is also a method in which a flow resistance member is provided in the liquid flow passage 7 of each nozzle. In this method, however, a flow resistance of the liquid flow passage 7 of each nozzle is increased, so that there arises a problem such that an ink re-supplying time is prolonged. Even in the case where the time for re-supplying the ink to the ejection outlets of the nozzles 300 is intended to be shortened, when a countermeasure to the reduction in degree of the cross-talk is taken, the ink re-supply consequently requires longer time.

As a method of reducing the degree of the cross-talk, in addition to the above-described method, there is also a method in which a flow resistance member is provided in the liquid flow passage 7 of each nozzle. In this method, however, a flow resistance of the liquid flow passage 7 of each nozzle is increased, so that there arises a problem such that an ink re-supplying time is prolonged. Even in the case where the time for re-supplying the ink to the ejection outlets of the nozzles 300 is intended to be shorten, when a countermeasure to the reduction in degree of the cross-talk is taken, the ink re-supply consequently requires longer time.

SUMMARY OF THE INVENTION

The present invention can solve the above-described problems. A principal object of the present invention is to provide an ink jet recording head which has prevented lengthening in ink re-supplying time with respect to nozzles and has reduced a degree of cross-talk between adjacent nozzles.

According to an aspect of the present invention an ink jet recording head comprises:

ejection energy generating elements for ejecting ink;

flow passages for supplying the ink from an ink supply port to the ejection energy generating elements through a common liquid chamber;

a partition wall formed between adjacent two flow passages;

a member disposed between the partition wall and the ink supply port; and an opening formed between the partition wall and the member;

wherein a flow resistance in the opening from one of the adjacent two flow passages to the other flow passage is different from that in the opening from the other flow passage to the one of the adjacent two flow passages.

In the present invention, by employing such a structure that a flow resistance is different depending on a flowing direction of ink through a flow passage for connecting adjacent nozzles, it is possible to prevent the lengthening in ink re-supplying time and reduce the degree of the cross-talk.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The recording head according to the present invention is characterized by having a structure in which a flow resistance is different depending on a flowing direction of ink between adjacent nozzles. Hereinbelow, embodiments of the recording head of the present invention will be described.

Embodiment 1

A constitution of a recording head of this embodiment will be described with reference to the drawings.

Figure 1:
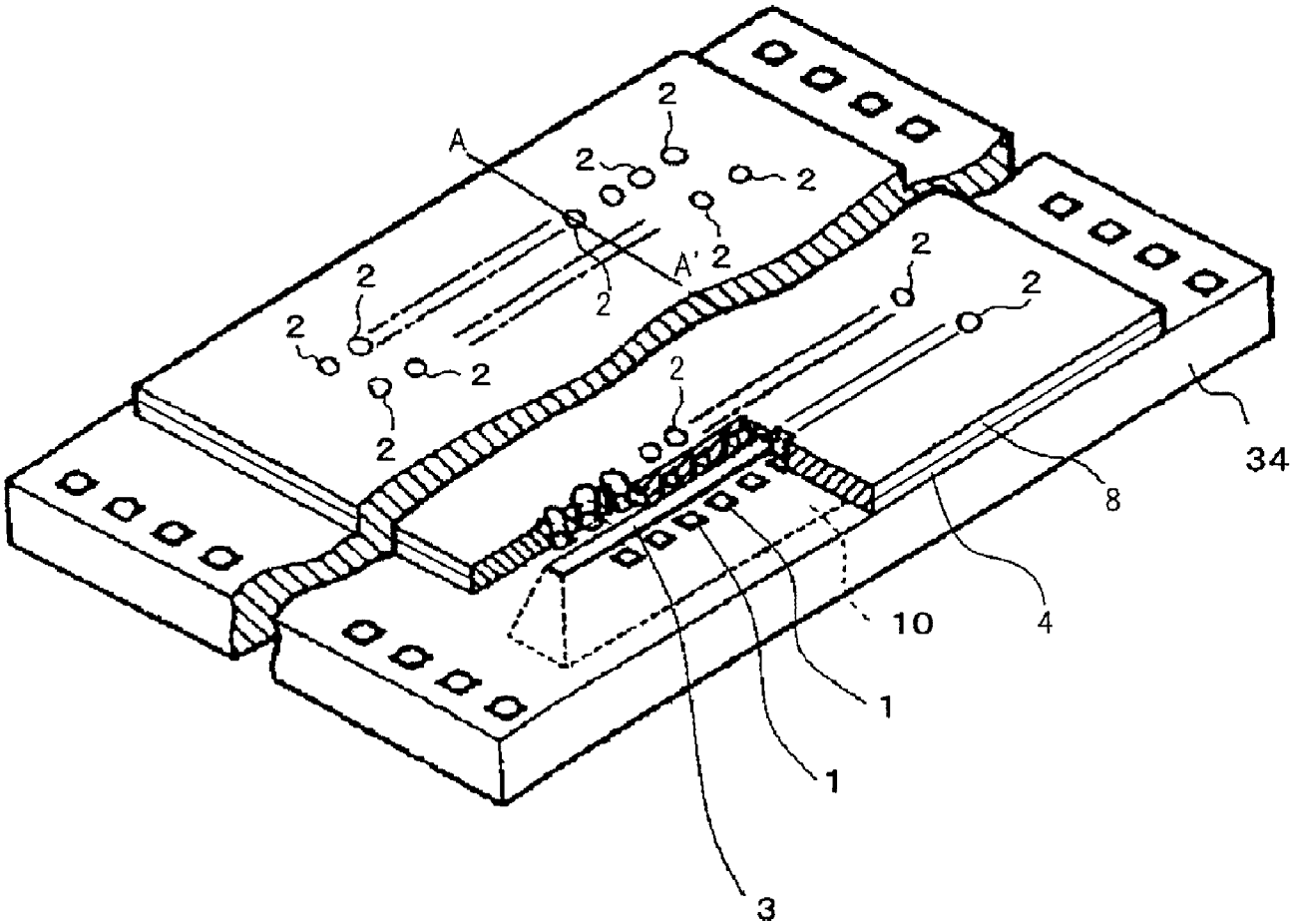
FIG. 1 is a schematic perspective view of a recording head in Embodiment 1.
Figure 2:
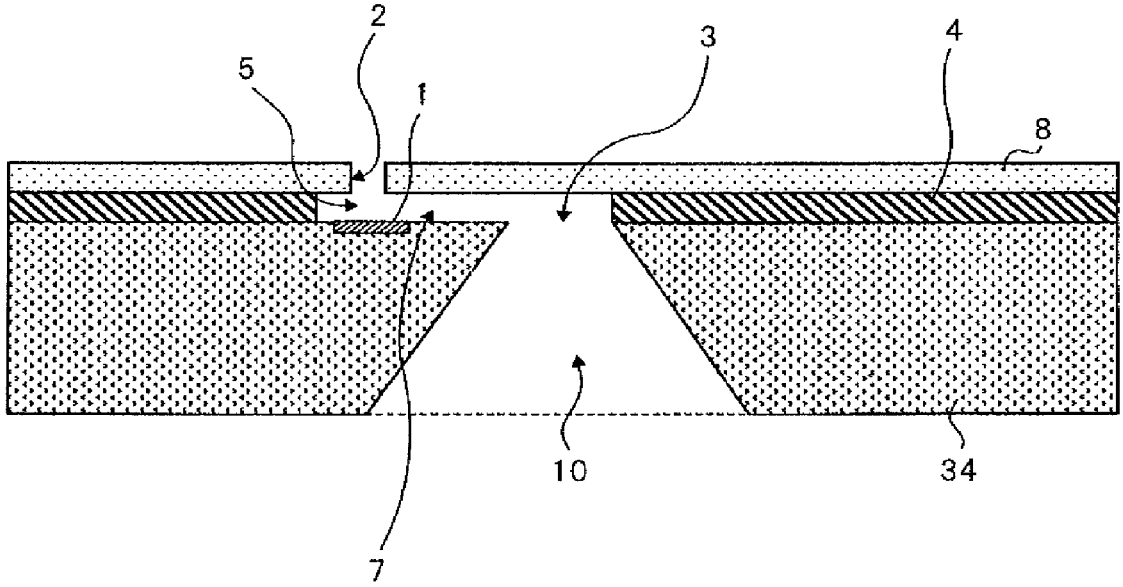
FIG. 2 is a schematic sectional view of the recording head shown in FIG. 1 taken along a line segment A-A' indicated in FIG. 1.

FIG. 1 is a perspective view of the recording head of this embodiment and FIG. 2 is a sectional view of the recording head taken along a line segment A-A' shown in FIG. 1. Not only in FIGS. 1 and 2 but also in other figures, a constitution of electrical wiring and the like for driving electrothermal transducer elements 1 is the same as in a conventional recording head, so that constituent members or portions thereof will be omitted from illustration and detailed description.

As shown in FIG. 1, on a substrate 34, an ejection outlet plate 8 is provided. An ink supplying chamber 10 is connected to a common liquid chamber and a liquid flow passage of an ejection portion through an ink supply port 3 of an opening portion provided on the substrate surface.

As shown in FIG. 1, on a surface of the substrate 34, the electrothermal transducer elements 1 as elements for generating ejection energy acting on ink ejection and the ink supply port 3 having an elongated rectangular shape are formed. The ink supply port 3 is a long groove-like through hole formed on the surface of the substrate 34 and corresponds to an opening toward the ink supplying chamber 10. The ink supplying chamber 10 is provided in a groove at a surface opposite to the surface of the substrate 34 on which the ejection electrothermal transducer element 1 are formed, and is connected to the ejection portion side through the ink supply port 3.

The electrothermal transducer elements 1 are arranged in a staggered fashion in a plurality of arrays including two arrays located on both sides of each ink supply port 3 with respect to a longitudinal direction of the ink supply port 3 with a pitch (interval) of 600 dpi. On the surface of the substrate 34, a flow passage constituting portion 4 is further provided and thereon, an ejection outlet plate 8 is formed to be connected to the flow passage constituting portion 4. The ejection outlet plate 8 is provided with ejection outlets 2 correspondingly to the electrothermal transducer elements 1.

The substrate 34 is formed of a material such as glass, ceramics, plastic, or metal. The substrate 34 functions as a part of the flow passage constituting portion 4 and the material for the substrate 34 is not particularly limited so long as the material is capable of functioning as a support for the ejection energy generating means, the ejection outlets 2, and a flow passage forming material layer described later. In this embodiment, as the substrate 34, a silicon substrate (wafer) is used.

As shown in FIG. 2, a plurality of liquid flow passages 7 for introducing the ink from the ink supply port 3 to a bubble generation chamber 5 located on each of the electrothermal transducer elements 1 is formed by the flow passage constituting portion 4. In the ejection outlet plate 8, ink ejection nozzles for causing the bubble generation chamber 5 to communicate with an outside of the recording head are formed. The ejection outlets 2 are openings which are provided and exposed at the surface of the ejection outlet plate 8 and are configured to eject the ink. Hereinafter, a portion including the liquid flow passage 7 formed by the flow passage constituting portion 4, the electrothermal transducer element 1, and the ejection outlet 2 is referred to as a "nozzle".

Figure 3A:
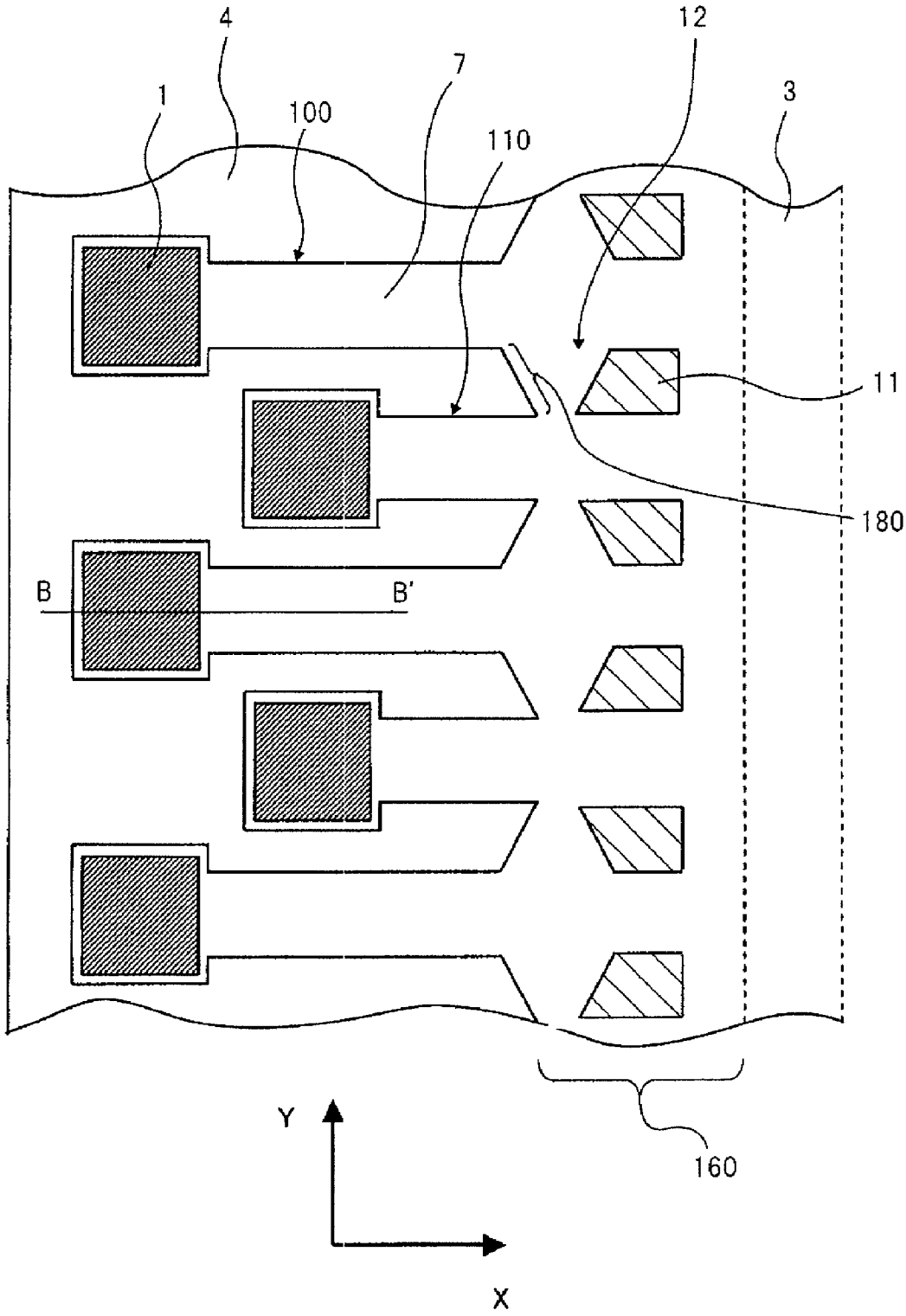
FIG. 3A is a schematic front view of an ejection portion formed on a substrate of the recording head shown in FIG. 1 and FIG. 2.
Figure 3B:
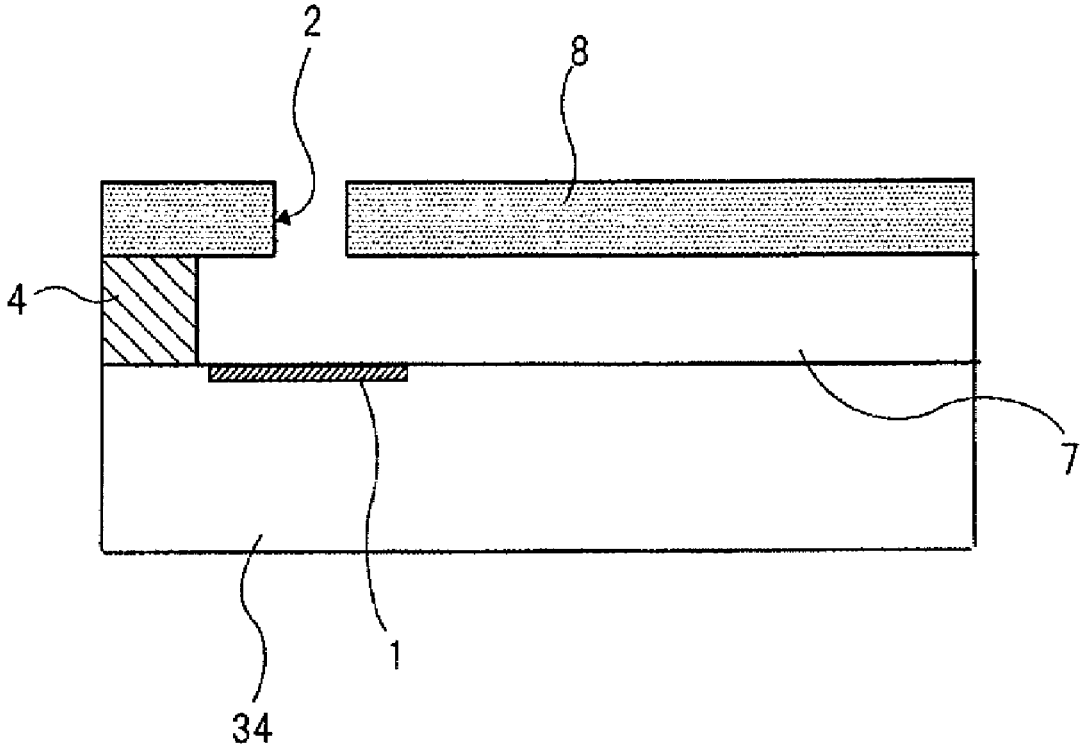
FIG. 3B is a schematic sectional view of the ejection portion taken along a line segment B-B' indicated in FIG. 3A.

FIG. 3A is a front view of the ejection portion formed on the substrate of the recording head shown in FIGS. 1 and 2, and FIG. 3B is a sectional view of the ejection portion taken along a line segment B-B' indicated in FIG. 3A. In this embodiment, the ejection outlet plate 8 and the flow passage constituting portion 4 are formed of the same member but can achieve a similar effect even when they are provided as different members.

As shown in FIG. 3A, in this embodiment, a resistance member 11 is provided in a common liquid chamber 160 between the flow passage constituting portion 4 and the ink supply port 3. Nozzles 100 having a longer liquid flow passage 7 and nozzles 110 having a shorter liquid flow passage 7 are disposed in a staggered fashion. The nozzles 100 and 110 have the same ejection amount for one ejection.

Further, a partition wall 180 has an ink supply port-side end facing the liquid flow passage 7 of the nozzle 100 and an ink supply port-side end facing the liquid flow passage 7 of the nozzle 110. These ink supply port-side ends have different distances, from the ink supply port 3, from each other. In FIG. 3A, the ink supply port-side end of the partition wall 180 with respect to the nozzle 100 is farther apart from the ink supply port 3 than that with respect to the nozzle 110.

By this constitution, with respect to the nozzle 100, the liquid flow passage 7 gradually spreads out at its ink supply port-side end portion. A flow passage 12, between the adjacent nozzles 100 and 110 through the partition wall 180, provided between the resistance member 11 and the flow passage constituting portion 4 gradually narrows from the nozzle 100 to the nozzle 110 with respect to a Y axis direction.

The flow passage 12 between the nozzles has a flow passage cross-sectional area changing at a constant rate from one of the liquid flow passages of the nozzles 100 and 110 to the other liquid flow passage or from the other liquid flow passage to the one of the liquid flow passages of the nozzles 100 and 110. In FIG. 3A, the flow passage cross-sectional area of the flow passage 12 between the nozzles is decreased from the liquid flow passage 7 of the nozzle 100 to the liquid flow passage 7 of the nozzle 110.

The change in flow passage cross-sectional area of the flow passage 12 between the nozzles is brought about by a change in width of the flow passage 12 between the nozzles, at a constant rate, from the nozzle 100 to the nozzle 110 or from the nozzle 110 to the nozzle 100.

By the constitution shown in FIG. 3A, the ink is more liable to flow from the nozzle 100 to the nozzle 110 and is less liable to flow from the nozzle 110 to the nozzle 100. For this reason, cross-talk from the nozzle 110 to the nozzle 100 is less liable to occur. Further, with respect to the nozzle 100, the liquid flow passage gradually spreads out at its ink supply port-side end portion, so that it is possible to shorten the ink re-supplying time.

Further, in the nozzle 110 having the shorter liquid flow passage 7, a viscosity resistance of the liquid flow passage 7 is low, so that it is possible to obtain a desired ink re-supplying time even when the liquid flow passage 7 is caused to gradually spread out at its ink supply port-side end portion. By providing the resistance member 11 as described above, such a structure that the flow resistance varies depending on whether the ink flowing direction is from a positive Y axis value to a negative Y axis value or from the negative Y axis value to the positive Y axis value is provided, so that it was possible to reduce a degree of the cross-talk without excessively increasing the ink re-supplying time.

Figure 5:
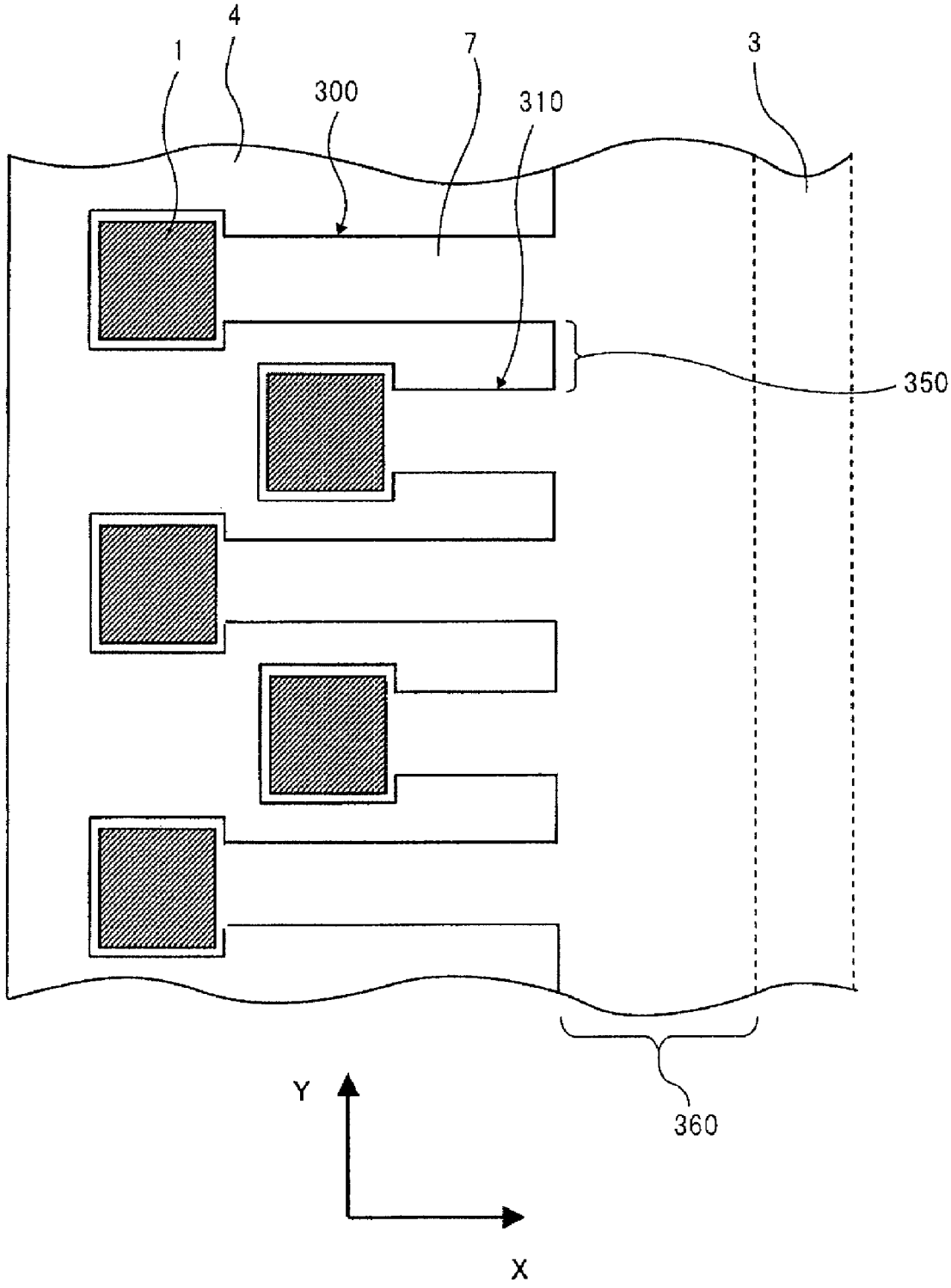
FIG. 5 is a schematic front view showing an embodiment of an ejection portion in the case where ejection outlets are arranged in a staggered fashion.

With reference to FIG. 5, a feature of the recording head of this embodiment will be described. In FIG. 5, an influence of cross-talk occurring in the nozzle 300 when a nozzle 310 causes bubble generation is larger than that of cross-talk occurring in the nozzle 310 when the nozzle 300 causes bubble generation. This is because the nozzle 310, in which the ejection outlet is closer to a common liquid chamber 360 is lower in flow resistance until the common liquid chamber 360 than the nozzle 300, facilitates flow of the ink during the bubble generation toward the common liquid chamber 360.

The recording head of this embodiment includes the flow passage, between nozzles connecting two liquid flow passages of the adjacent nozzles, provides between the resistance member and the liquid flow passage which are located between the adjacent nozzles in such a constitution that the nozzles having the same ejection amount are disposed in the staggered fashion. The flow passage between the nozzles is configured to narrow from the nozzle having the longer liquid flow passage toward the nozzle having the shorter liquid flow passage. For that reason, the ink is less liable to flow from the nozzle having the shorter liquid flow passage to the nozzle having the longer liquid flow passage. Even when a flow resistance member is not provided in each of the liquid flow passages, the ink is less liable to flow in a direction in which the cross-talk is more liable to occur between the two nozzles and the ink is more liable to flow in a direction in which the cross-talk is less liable to occur. As a result, it is possible to not only prevent the increase in time for supplying the ink to the nozzle but also reduce the degree of the cross-talk.

Embodiment 2

In this embodiment, the adjacent nozzles are different in ink ejection amount.

Figure 4:
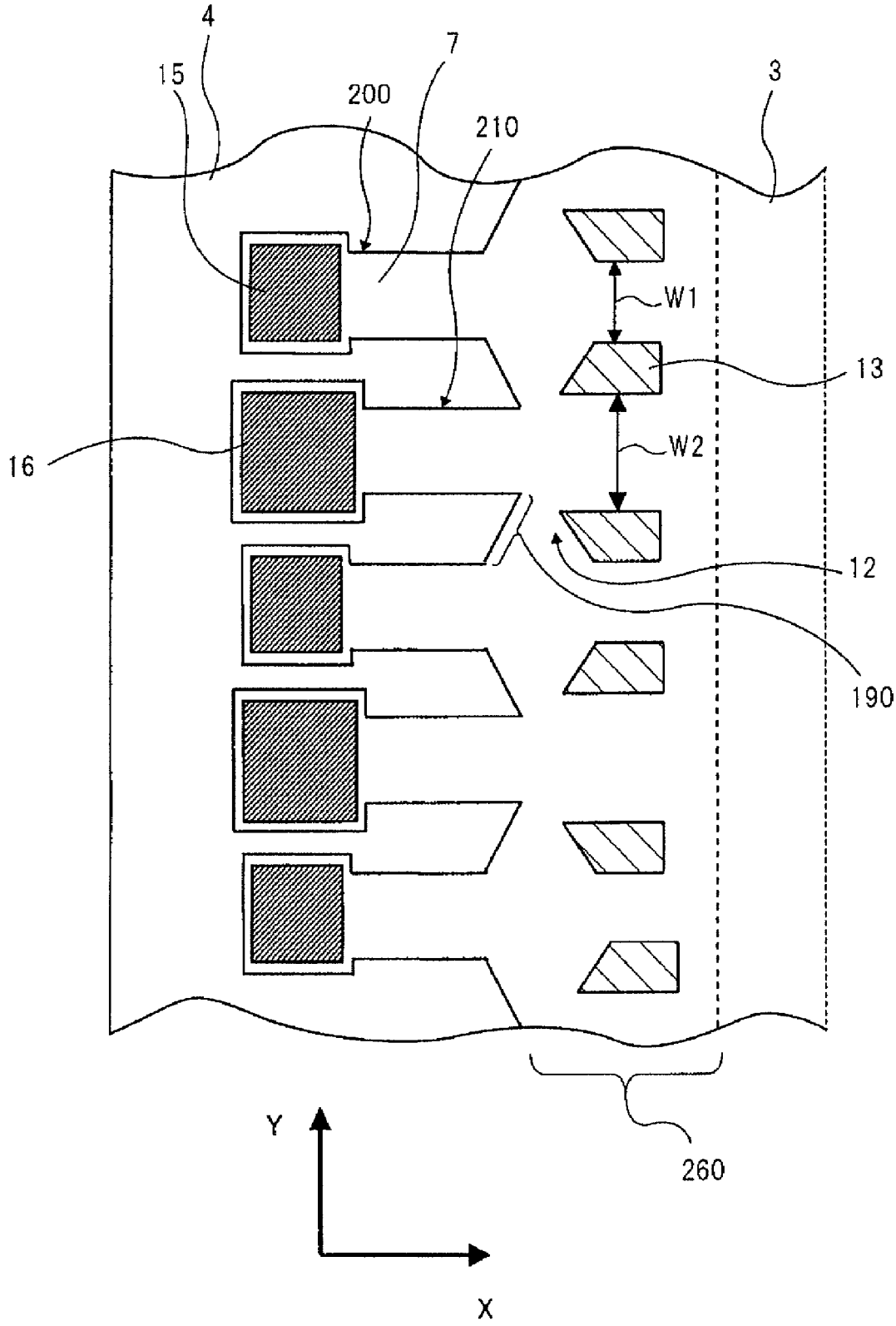
FIG. 4 is a schematic front view of an ejection portion of a recording head in Embodiment 2.

FIG. 4 is a front view of an ejection portion of a recording head of this embodiment. In this embodiment, the ejection outlet plate 8 and the flow passage constituting portion 4 are formed of the same member but can achieve a similar effect even when they are provided as different members.

As shown in FIG. 4, in this embodiment, a resistance member 13 is provided in a common liquid chamber 260 between the flow passage constituting portion 4 and the ink supply port 3.

Nozzles 200 having a predetermined ink ejection amount for one ejection (shot) and nozzles 210 having an ink ejection amount larger than the predetermined ink ejection amount are alternately disposed. An electrothermal transducer element 15 of the nozzle 200 is smaller in size than an electrothermal transducer element 16 of the nozzle 210, thus being smaller in amount of the ink flowing toward the liquid flow passage side during the bubble generation than the electrothermal transducer element 16 of the nozzle 210. In other words, the electrothermal transducer element 16 of the nozzle 210 is larger in size than the electrothermal transducer element 15 of the nozzle 200, thus being larger in amount of the ink flowing toward the liquid flow passage side during the bubble generation than the electrothermal transducer element 15 of the nozzle 200. For this reason, with respect to the amount of ink flowing between the adjacent nozzles during the bubble generation, the amount of ink flowing from the nozzle 210 toward the nozzle 200 is larger than that of ink flowing from the nozzle 200 toward the nozzle 210.

Further, a partition wall 190 has an ink supply port-side end facing the liquid flow passage 7 of the nozzle 200 and an ink supply port-side end facing the liquid flow passage 7 of the nozzle 210. These ink supply port-side ends have different distances, from the ink supply port 3, from each other. In FIG. 4, the ink supply port-side end of the partition wall 190 with respect to the nozzle 200 is farther apart from the ink supply port 3 than that with respect to the nozzle 210.

By this constitution, as shown in FIG. 4, with respect to the nozzle 200, the liquid flow passage 7 gradually spreads out at its ink supply port-side end portion. A flow passage 12, between the adjacent nozzles 200 and 210, provided between the resistance member 11 and the flow passage constituting portion 4, gradually narrows from the nozzle 200 to the nozzle 210 with respect to a Y axis direction.

The flow passage 12 between the nozzles has a flow passage cross-sectional area changing at a constant rate from one of the liquid flow passages of the nozzles 200 and 210 to the other liquid flow passage or from the other liquid flow passage to the one of the liquid flow passages of the nozzles 200 and 210. In FIG. 4, the flow passage cross-sectional area of the flow passage 12 between the nozzles is decreased from the liquid flow passage 7 of the nozzle 200 to the liquid flow passage 7 of the nozzle 210.

In this structure, the ink is more liable to flow from the nozzle 200 to the nozzle 210 and is less liable to flow from the nozzle 210 to the nozzle 200. For this reason, cross-talk from the nozzle 210 to the nozzle 200 is less liable to occur.

The resistance member 13 is provided at a position closer to the ink supply port 3 than the flow passage 12 between the nozzles. By the resistance member 13, a width of the liquid flow passage 7 at a position closer to the ink supply port 3 than the flow passage 12 between the nozzles is determined.

The nozzles 210 and 200 have different distances between adjacent resistance members. In FIG. 4, a distance W2 between the adjacent resistance members of the nozzle 210 is wider than a distance W1 between the adjacent resistance members of the nozzle 200. This relationship is established for facilitating the ink flow toward the ink supply port during the bubble generation in the nozzle 210 by lowering the flow resistance at the position closer to the ink supply port 3 when compared with that of the flow passage 12 between the nozzles. By this constitution, it is possible to not only make the ink less liable to flow from the nozzle 210 to the nozzle 200 but also shorten the ink re-supplying time by increasing the distance between the adjacent resistance members.

As in this embodiment, in the case where the nozzles having the different ejection amounts for one ejection (shot) are disposed adjacently to each other, the ejection heater is required to increase in size in order to eject a relatively large ejection amount of the ink. An influence of cross-talk of the nozzle 210 increased in the ejection heater size on the nozzle 200 is larger than that of cross-talk of the nozzle 200 on the nozzle 210.

The recording head of this embodiment is configured to increase the distance between the adjacent resistance members with respect to the nozzle from which the relatively large amount of the ink is ejected in such a constitution that the nozzles different in ejection amount are disposed adjacently to each other. By such a constitution, the ink is less liable to flow from the nozzle having the relatively large ink ejection amount to the nozzle having the relatively small ink ejection amount. Even when a flow resistance member is not provided in each of the liquid flow passages, the ink is less liable to flow in a direction in which the cross-talk is more liable to occur between the adjacent nozzles and the ink is more liable to flow in a direction in which the cross-talk is less liable to occur. As a result, it is possible to achieve an effect similar to that in Embodiment 1.

Incidentally, the constitution of changing the width between the adjacent resistance members in this embodiment may also be applied to Embodiment 1. In this case, a width of the liquid flow passage 7 of the nozzle 110 is made larger than that of the liquid flow passage 7 of the nozzle 100. Further, the constitution of FIG. 4 includes both of the ejection amount changing constitution and the nozzle width changing constitution but may also include either one of these constitutions.

In this embodiment, the flow passage, between the adjacent nozzles, provided between the adjacent two liquid flow passages through the partition wall is changed in flow resistance between the case in which the ink flows from one liquid flow passage of the two liquid flow passages to the other liquid flow passage and the case in which the ink flows from the other liquid flow passage to the one liquid flow passage. The internozzle flow passage connecting the adjacent nozzles is configured to have a different flow resistance depending on the ink flow direction, so that the flow resistance is decreased with respect to the direction in which the influence of cross-talk is small and is increased with respect to the direction in which the influence of cross-talk is large.

By employing such a constitution, the ink is less liable to flow in the direction in which the cross-talk is more liable to occur between the adjacent nozzles and is more liable to flow in the direction in which the cross-talk is less liable to occur. Even in the recording head in which the nozzles different in length of the liquid flow passage are alternately disposed and the recording head in which the nozzles different in ink ejection amount for one shot are alternately disposed, it is possible to prevent the lengthening of the ink re-supplying time and reduce the degree of the cross-talk.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 310942/2007 filed Nov. 30, 2007, which is hereby incorporated by reference herein.

What is claimed is:

1. An ink jet recording head comprising:

ejection energy generating elements for ejecting ink;

flow passages for supplying the ink from an ink supply port to said ejection energy generating elements through a common liquid chamber;

a partition wall formed between two adjacent flow passages;

a member disposed between said partition wall and the ink supply port; and an opening formed between said partition wall and said member, wherein a flow resistance in said opening from one of the two adjacent flow passages to the other of the two adjacent flow passages is less than that in the opening from the other of the two adjacent flow passages to the one of the two adjacent flow passages, wherein said partition wall has a first ink supply port-side end facing the one of the two adjacent flow passages and a second ink supply port-side end facing the other of the two adjacent flow passages, the first and second ink supply port-side ends having different distances from the ink supply port, wherein the other of the two adjacent flow passages has a distance, from the ink supply port to an associated ejection energy generating element, shorter than that of the one of the two adjacent flow passages, and wherein the first ink supply port-side end is more distant from the ink supply port than the second ink supply port-side end.

2. A head according to claim 1, wherein said opening is changed in cross-sectional area from the one of the two adjacent flow passages to the other of the two adjacent flow passages.

3. A head according to claim 2, wherein the other of the two adjacent flow passages has a distance, from the ink supply port to an associated ejection energy generating element, shorter than that of the one of the two adjacent flow passages, and wherein the opening is decreased in cross-sectional area from the one of the two adjacent flow passages to the other of the two adjacent flow passages.

4. A head according to claim 2, wherein an ejection energy generating element provided corresponding to the other of the two adjacent flow passages has an ejection amount larger than that of an ejection energy generating element provided corresponding to the one of the two adjacent flow passages, and wherein the opening is decreased in cross-sectional area from the one of the two adjacent flow passages to the other of the two adjacent flow passages.

5. A head according to claim 1, wherein an ejection energy generating element provided corresponding to the other of the two adjacent flow passages has an ejection amount larger than that of an ejection energy generating element provided corresponding to the one of the two adjacent flow passages, and wherein said member includes a plurality of member portions disposed so that a distance between two adjacent member portions with respect to the other of the two adjacent flow passages is larger than that with respect to the one of the two adjacent flow passages.

6. An ink jet recording head comprising:

ejection energy generating elements for ejecting ink;

flow passages for supplying the ink from an ink supply port to said ejection energy generating elements through a common liquid chamber;

a partition wall formed between two adjacent flow passages;

a member disposed between said partition wall and the ink supply port; and an opening formed between said partition wall and said member, wherein a flow resistance in said opening from one of the two adjacent flow passages to the other of the two adjacent flow passages is less than that in the opening from the other of the two adjacent flow passages to the one of the two adjacent flow passages, wherein said partition wall has a first ink supply port-side end facing the one of the two adjacent flow passages and a second ink supply port-side end facing the other of the two adjacent flow passages, the first and second ink supply port-side ends having different distances from the ink supply port, wherein an ejection energy generating element provided corresponding to the other of the two adjacent flow passages is structured to have an ejection amount larger than that of an ejection energy generating element provided corresponding to the one of the two adjacent flow passages, and wherein the first ink supply port-side end is more distant from the ink supply port than the second ink supply port-side end.

* * * * *